US006415763B1

(12) United States Patent
Kobayashi

(10) Patent No.: US 6,415,763 B1
(45) Date of Patent: Jul. 9, 2002

(54) DEVICE AND METHOD FOR CONTROLLING FUEL INJECTION AMOUNT OF INTERNAL COMBUSTION ENGINE

(75) Inventor: Masayuki Kobayashi, Ageo (JP)

(73) Assignee: Nissan Diesel Motor Co., Ltd., Saitama (JP)

( * ) Notice: Subject to any disclaimer, the term of this patent is extended or adjusted under 35 U.S.C. 154(b) by 0 days.

(21) Appl. No.: 09/700,773

(22) PCT Filed: Mar. 31, 2000

(86) PCT No.: PCT/JP00/02111

§ 371 (c)(1),
(2), (4) Date: Feb. 1, 2001

(87) PCT Pub. No.: WO00/58616

PCT Pub. Date: Oct. 5, 2000

(30) Foreign Application Priority Data

Mar. 31, 1999 (JP) ..... 11-091876

(51) Int. Cl.[7] ..... F02D 9/06
(52) U.S. Cl. ..... 123/326; 123/682; 123/493
(58) Field of Search ..... 123/325, 326, 123/324, 682, 683, 492, 493

(56) References Cited

U.S. PATENT DOCUMENTS

| | | | | | |
|---|---|---|---|---|---|
| 4,527,521 | A | * | 7/1985 | Hasegawa et al. | 123/326 |
| 4,644,922 | A | * | 2/1987 | Glockler et al. | 123/493 |
| 4,700,673 | A | * | 10/1987 | Denz | 123/325 |
| 5,762,043 | A | * | 6/1998 | Yoshioka et al. | 123/325 |
| 6,222,226 | B1 | * | 4/2001 | Alm et al. | 123/493 |

FOREIGN PATENT DOCUMENTS

| | | |
|---|---|---|
| JP | 59-003130 | 1/1984 |
| JP | 06-066160 | 3/1994 |
| JP | 06-213014 | 8/1994 |
| JP | 06-330784 | 11/1994 |
| JP | 07-22048 | 4/1995 |

* cited by examiner

*Primary Examiner*—Erick Solis
(74) *Attorney, Agent, or Firm*—Lawrence E. Laubscher, Jr.

(57) ABSTRACT

In an internal combustion engine mounted on a vehicle, the constitution is such that the fuel injection quantity is switched to correspond to the operating state of said engine while being gradually increased when an auxiliary brake is switched from a non-operating state to an operating state, thereby preventing excessive fuel supply due to a time delay in the operation of the auxiliary brake, and improving the exhaust property.

5 Claims, 6 Drawing Sheets

DEVICE AND METHOD FOR CONTROLLING FUEL INJECTION AMOUNT OF INTERNAL COMBUSTION ENGINE

FIELD OF THE INVENTION

The present invention relates to a method and a device for controlling a fuel injection quantity of an internal combustion engine equipped with an auxiliary brake, and more specifically, technology for improving the exhaust property when the auxiliary brake is released.

DESCRIPTION OF THE RELATED ART

Brake units used for decelerating and stopping a vehicle can be classified into a main brake for braking a rotary body equipped to wheels and auxiliary brakes other than the main brake. Examples of the auxiliary brake include an exhaust brake for closing a shutter equipped to an exhaust passage to brake the rotary body by means of an exhaust resistance, or an engine brake for discharging compressed air inside a cylinder near the termination of compression stroke to brake the rotary body by means of the throttle loss (Japanese Unexamined Utility Model Publication No. 7-22048).

However, since the operation of the auxiliary brake is accompanied with a time delay, it is likely to cause following problems when releasing the auxiliary brake. That is, when the auxiliary brake is released, a fuel injection quantity is increased from the injection quantity during the operation of auxiliary brake to the injection quantity corresponding to the accelerator opening. Since the increase of fuel injection quantity is performed with good response, fuel tends to be supplied excessively until the release of the auxiliary brake is completed, causing incomplete combustion of the air-fuel mixture to deteriorate the exhaust property.

Therefore, in order to solve the above-mentioned conventional problems the present invention aims at providing a fuel injection quantity control device of an internal combustion engine having improved exhaust property while maintaining good response during release of the auxiliary brake.

SUMMARY OF THE INVENTION

In order to achieve the above object, the present invention is constituted such that a judgment is made as to whether an auxiliary brake is operating or not, and when the auxiliary brake is switched from a non-operating state to an operating state, a fuel injection quantity is switched to correspond to an engine operating state while being gradually increased.

More specifically, the constitution of the present invention is such that a basic fuel injection quantity is computed based on the engine operating state, a maximum fuel injection quantity limiting the upper limit of the computed basic fuel injection quantity is computed as a first maximum fuel injection quantity which is the minimum value during the auxiliary brake is operating, and as a second maximum fuel injection quantity that is gradually increased corresponding to the elapsed time from when the auxiliary brake has been released during the auxiliary brake is not operating, and the smaller value between the computed basic fuel injection quantity and the maximum fuel injection quantity is selected as the fuel injection quantity to control a fuel injection device.

According to this constitution, if the auxiliary brake is operating, a first fuel injection quantity is computed as the maximum fuel injection quantity during the operation of auxiliary brake. On the other hand, when the auxiliary brake is not operating, a second fuel injection quantity that is gradually increased corresponding to the elapsed time from when the auxiliary brake is released is computed as the maximum fuel injection quantity. Then, between the computed maximum fuel injection quantity and the basic fuel injection quantity computed based on the engine operating state, the smaller value is selected as a fuel injection quantity, and the fuel injection device is controlled based on the selected fuel injection quantity.

Therefore, if the first fuel injection quantity is set for example to a minimum value (normally "0"), the fuel consumption during the operation of auxiliary brake can be restrained. On the other hand, during the auxiliary brake is not operating, since the maximum fuel injection quantity limiting the maximum value of the basic fuel injection quantity is gradually increased corresponding to the elapsed time from when the auxiliary brake has been released, the increase rate is appropriately set so as to enable to avoid excessive fuel supply state that may occur when the auxiliary brake is released. Moreover, the fuel can be injected to the engine even during the acceleration state immediately after release of the auxiliary brake.

In this way, the fuel consumption during the operation of auxiliary brake can be reduced. Further, the exhaust property while maintaining good response can be improved during release of the auxiliary brake.

The constitution may be such that the second fuel injection quantity is increased stepwise corresponding to the elapsed time from when the auxiliary brake has been released.

According to this constitution, when the second fuel injection quantity is computed using a map or a table, memories used for the map and the like can be reduced since the components of the map and the like are reduced.

Further, the constitution may be such that, as the maximum fuel injection quantity, the second fuel injection quantity may be computed by referring to a map in which the fuel injection quantity is set corresponding to the elapsed time from when the auxiliary brake has been released.

According to this constitution, the second fuel injection quantity is computed by referring to the map, to thereby prevent an increase of processing load accompanied by the computation.

Moreover, when a plurality of auxiliary brakes are equipped to the engine, the constitution may be such that, if at least one of the auxiliary brakes is operating, it is judged that the auxiliary brake is operating to compute the maximum fuel injection quantity.

According to this constitution, even when various auxiliary brakes, such as the exhaust brake, the engine brake and the like, are equipped to the engine, the maximum fuel injection quantity during the operation of auxiliary brake is computed if at least one of the auxiliary brakes is operating, thereby capable of reducing the fuel consumption even further.

DETAILED DESCRIPTION OF THE PREFERRED EMBODIMENT

The present invention will now be explained with reference to the accompanied drawings.

Figure 1:
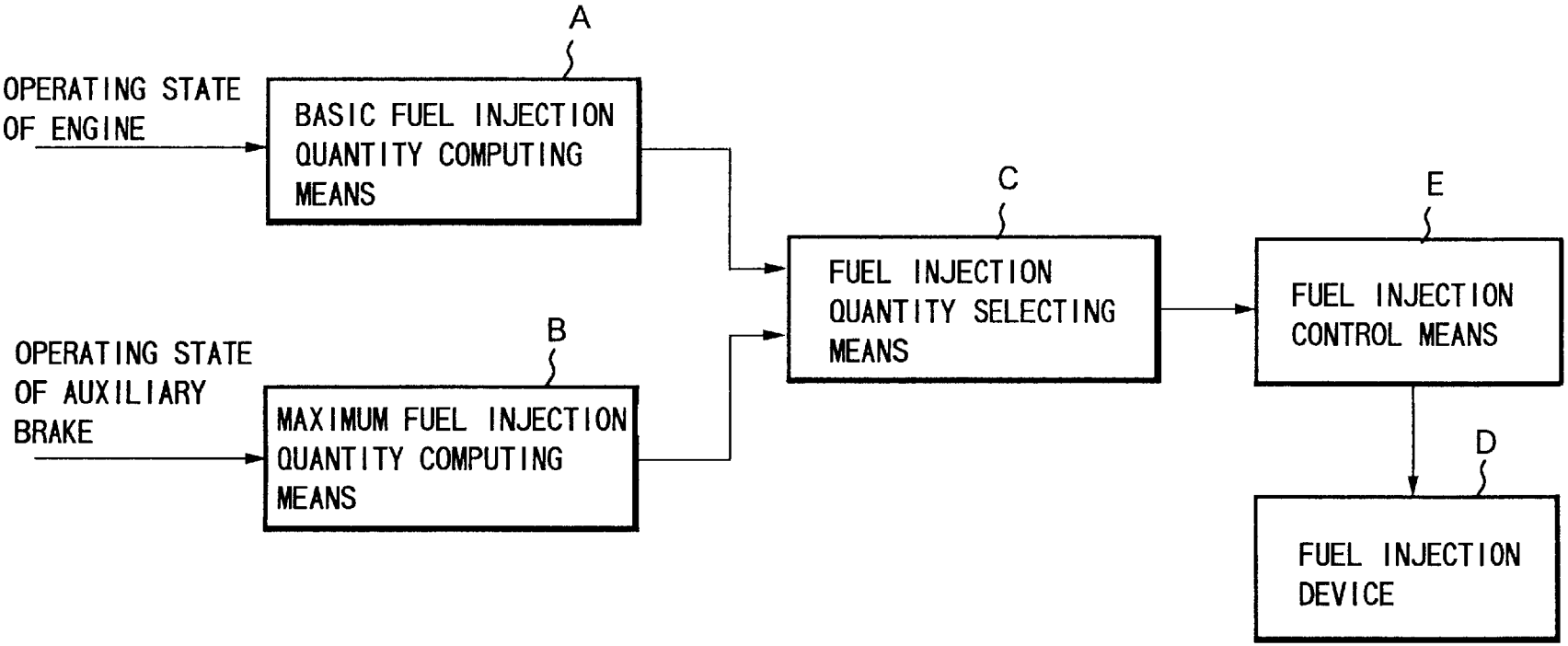
FIG. 1 is a block diagram showing the structure of the present invention.

The present invention comprises respective means shown in FIG. 1.

A basic fuel injection quantity computing means A computes a basic fuel injection quantity based on an operating state of engine.

A maximum fuel injection quantity computing means B computes a maximum fuel injection quantity limiting the upper limit value of the basic fuel injection quantity, as a first maximum fuel injection quantity which is the minimum value during operation of an auxiliary brake if the auxiliary brake is operating, and as a second maximum fuel injection quantity that is gradually increased corresponding to the elapsed time from when the auxiliary brake has been released if the auxiliary brake is not operating.

A fuel injection quantity selecting means C selects, as a fuel injection quantity, the smaller value between the computed basic fuel injection quantity and the maximum fuel injection quantity.

A fuel injection control means E controls a fuel injection device D based on the selected fuel injection quantity.

Figure 2:
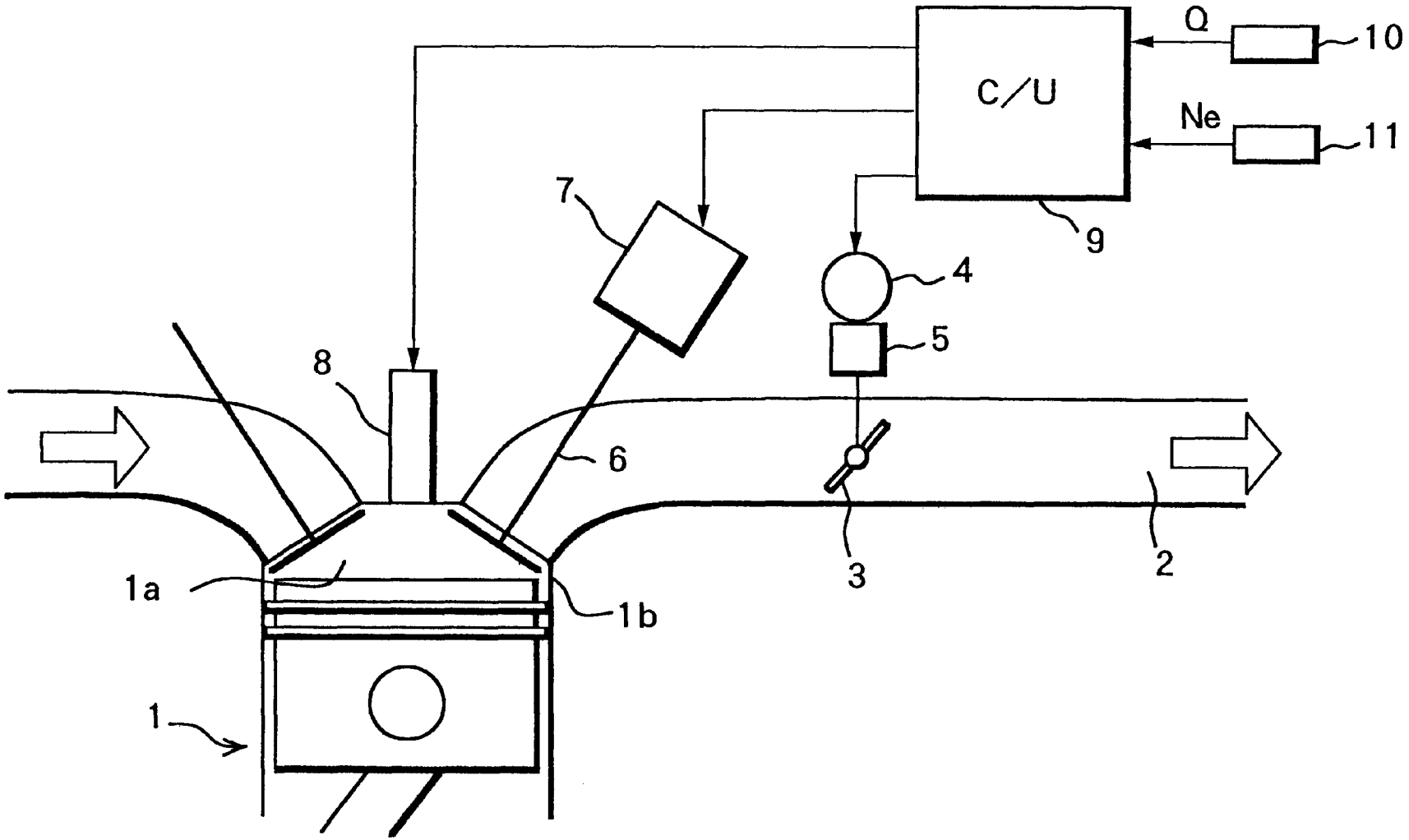
FIG. 2 shows the whole structure of a diesel engine to which the fuel injection quantity control device according to the present invention is applied.

FIG. 2 shows the whole structure of a diesel engine equipped with an exhaust brake and an engine brake, to which is applied the fuel injection quantity control device of an internal combustion engine according to the present invention (hereinafter referred to as "fuel injection quantity control device").

An exhaust passage 2 of the diesel engine 1 is equipped with a shutter 3 constituting an exhaust brake. The shutter 3 is driven to rotate by an air actuator 5 controlled via an electromagnetic valve 4, and performs a function as an exhaust brake by shutting the exhaust passage 2. Moreover, an exhaust valve 6 of the diesel engine 1 is disposed with an engine brake 7 that opens the exhaust valve 6 for a predetermined open degree near the termination of compression stroke, discharges compressed air inside a combustion chamber 1*a* to perform the braking by the throttle loss. Further, a fuel injection device 8 is disposed to a cylinder head 1*b* to face the combustion chamber 1*a*. The electromagnetic valve 4, the engine brake 7 and the fuel injection device 8 are controlled by a control unit 9 incorporating a microcomputer.

The fuel injection quantity control device is further equipped with an opening sensor 10 for detecting an accelerator opening θ as an engine operating state, and a rotation speed sensor 11 for detecting an engine rotation speed Ne. Outputs from the opening sensor 10 and the rotation speed sensor 11 are respectively input to the control unit 9, to control an operation of auxiliary brake and to control a fuel injection quantity. Instead of the engine operating state detected by the opening sensor 10, the position of a control lever of an electronic governor (not shown) can be made the engine operating state.

Figure 3:
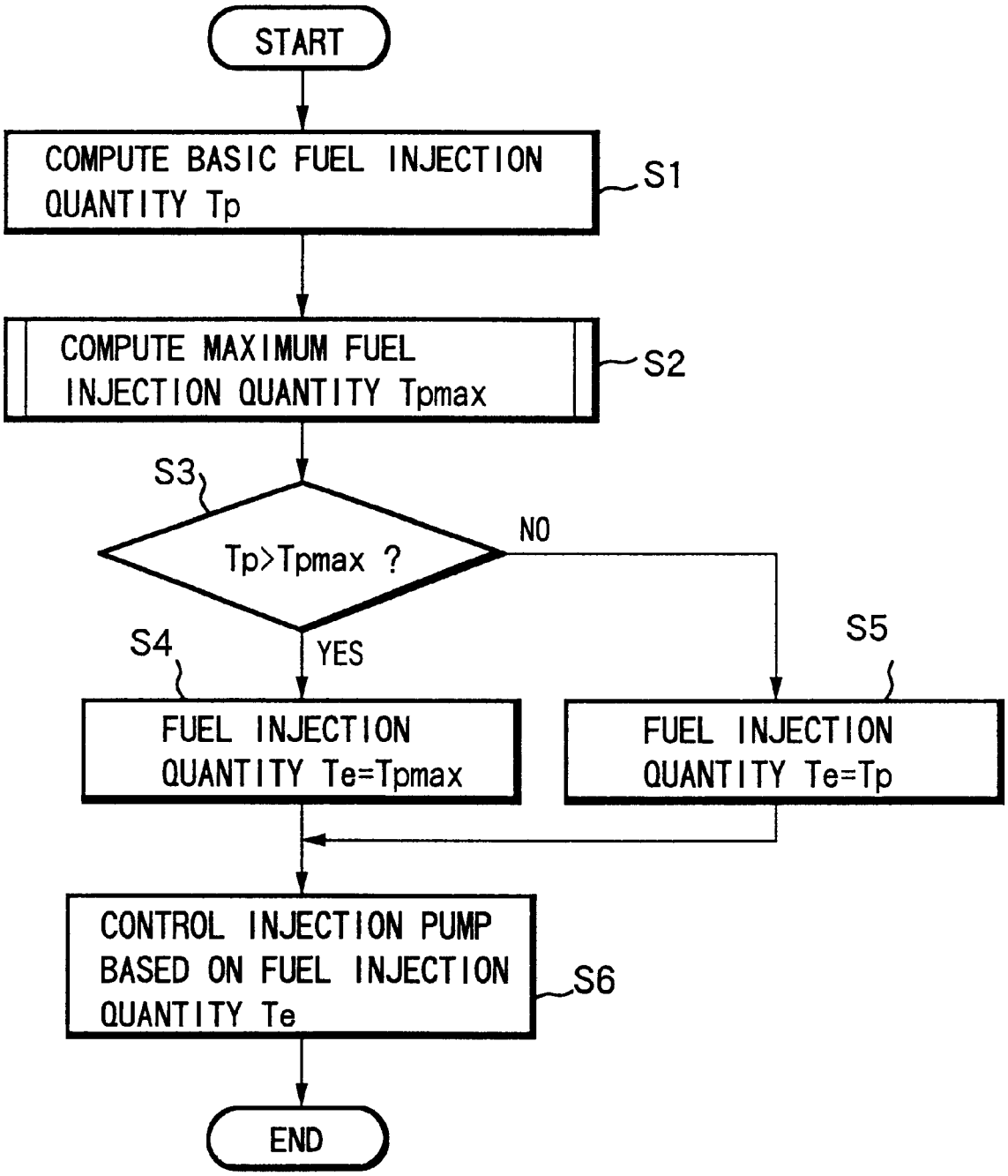
FIG. 3 is a flowchart showing the control of the fuel injection quantity.

Next, the fuel injection quantity control performed by the fuel injection quantity control device having the above-explained constitution will be explained with reference to the flowchart of FIG. 3.

In step 1 (hereinafter referred to as "S1", same for other steps), a basic fuel injection quantity Tp according to the engine operating state is computed. In other words, based on the accelerator opening θ detected by the opening sensor 10 and the engine rotation speed Ne detected by the rotation speed sensor 11, the basic fuel injection quantity Tp is computed with reference to a map and the like not shown. The process of step 1 corresponds to the basic fuel injection quantity computing means.

In step 2, based on the operating state of the auxiliary brake, a subroutine is called in order to compute the maximum fuel injection quantity Tpmax limiting the maximum value of the basic fuel injection quantity Tp. The computation of the maximum fuel injection quantity Tpmax corresponds to the maximum fuel injection quantity computing means.

In step 3, it is determined whether or not the basic fuel injection quantity Tp is greater than the maximum fuel injection quantity Tpmax. When the basic fuel injection quantity Tp is greater than the maximum fuel injection quantity Tpmax, the routine is advanced to step 4 (Yes), where the maximum fuel injection quantity Tpmax is set as a fuel injection quantity Te (Te=Tpmax). On the other hand, when the basic fuel injection quantity Tp is equal to or smaller than the maximum fuel injection quantity Tpmax, the routine is advanced to step 5 (No), where the basic fuel injection quantity Tp is set as the fuel injection quantity Te (Te=Tp). In other words, the smaller value between the basic fuel injection quantity Tp and the maximum fuel injection quantity Tpmax is selected as the fuel injection quantity Te. The process of steps 3 through 5 corresponds to the fuel injection quantity selecting means.

In step 6, the fuel injection device 8 is controlled based on the fuel injection quantity Te selected as above, to inject a predetermined amount of fuel spray to the combustion chamber 1*a*. The process of step 6 corresponds to the fuel injection control means.

Figure 4:
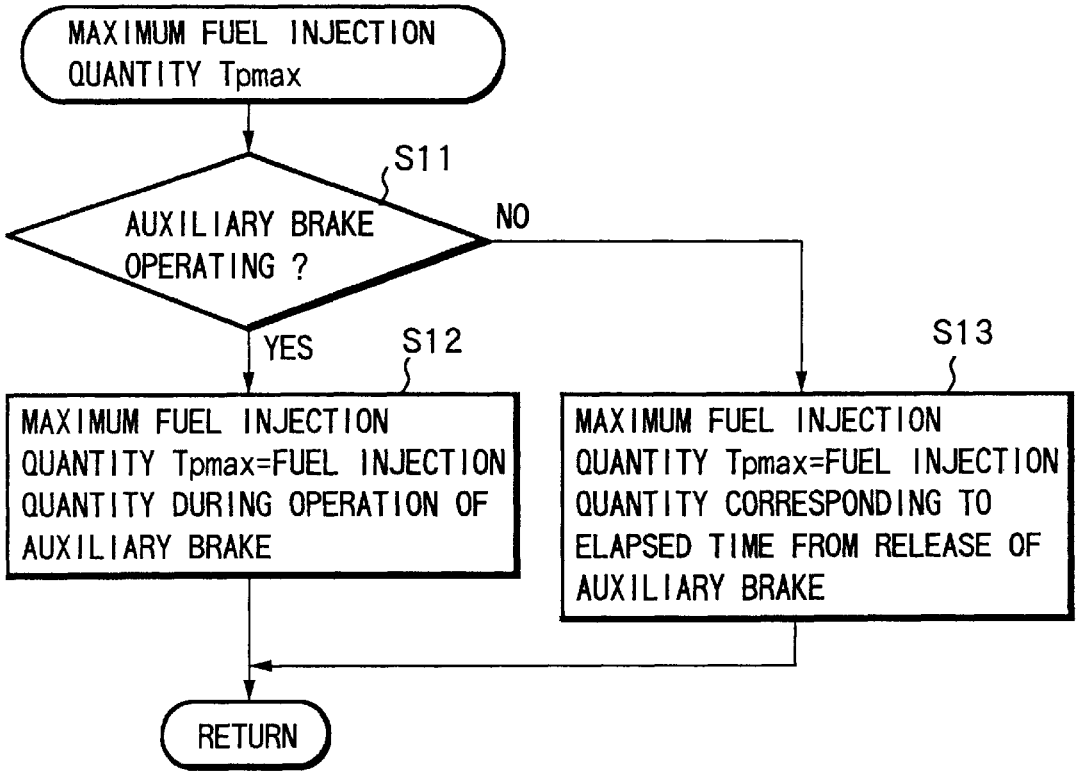
FIG. 4 is a flowchart showing the subroutine used to compute the maximum fuel injection quantity.

FIG. 4 is a flowchart showing the computing process of the maximum fuel injection quantity Tpmax in step 2.

In step 11, determination is made on whether or not the auxiliary brake is operating. The determination on whether or not the auxiliary brake is operating can be made for example by judging whether or not the accelerator opening θ detected by the opening sensor 10 is "0", in other words, whether or not the operating condition of the auxiliary brake is fulfilled. Then, when the auxiliary brake is operating, the routine is advanced to step 12 (Yes), while when the auxiliary brake is not operating, the routine is advanced to step 13 (No).

In step 12, the fuel injection quantity (first maximum fuel injection quantity) during the operation of auxiliary brake is computed as the maximum fuel injection quantity Tpmax. At this time, the fuel injection quantity during the operation of auxiliary brake is at a minimum value, which is normally set to a fixed value "0".

Figure 5:
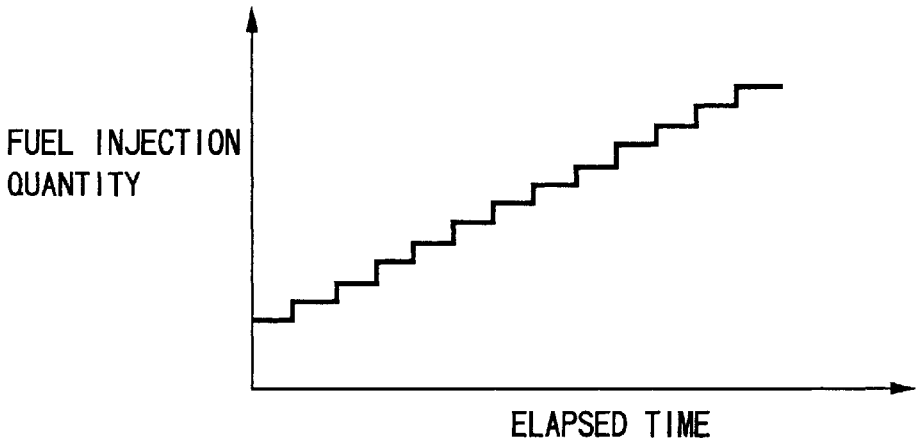
FIG. 5 is an explanatory view showing a map used for computing the maximum fuel injection quantity of when the auxiliary brake is released.

In step 13, the fuel injection quantity (second maximum fuel injection quantity) corresponding to the elapsed time from when the auxiliary brake has been released is computed as the maximum fuel injection quantity Tpmax. At this time, the fuel injection quantity is computed by referring to a map in which the fuel injection quantity is set in relation to the elapsed time as shown in FIG. 5. The map is set so that the fuel injection quantity is gradually increased stepwise corresponding to the elapsed time.

Figure 6:
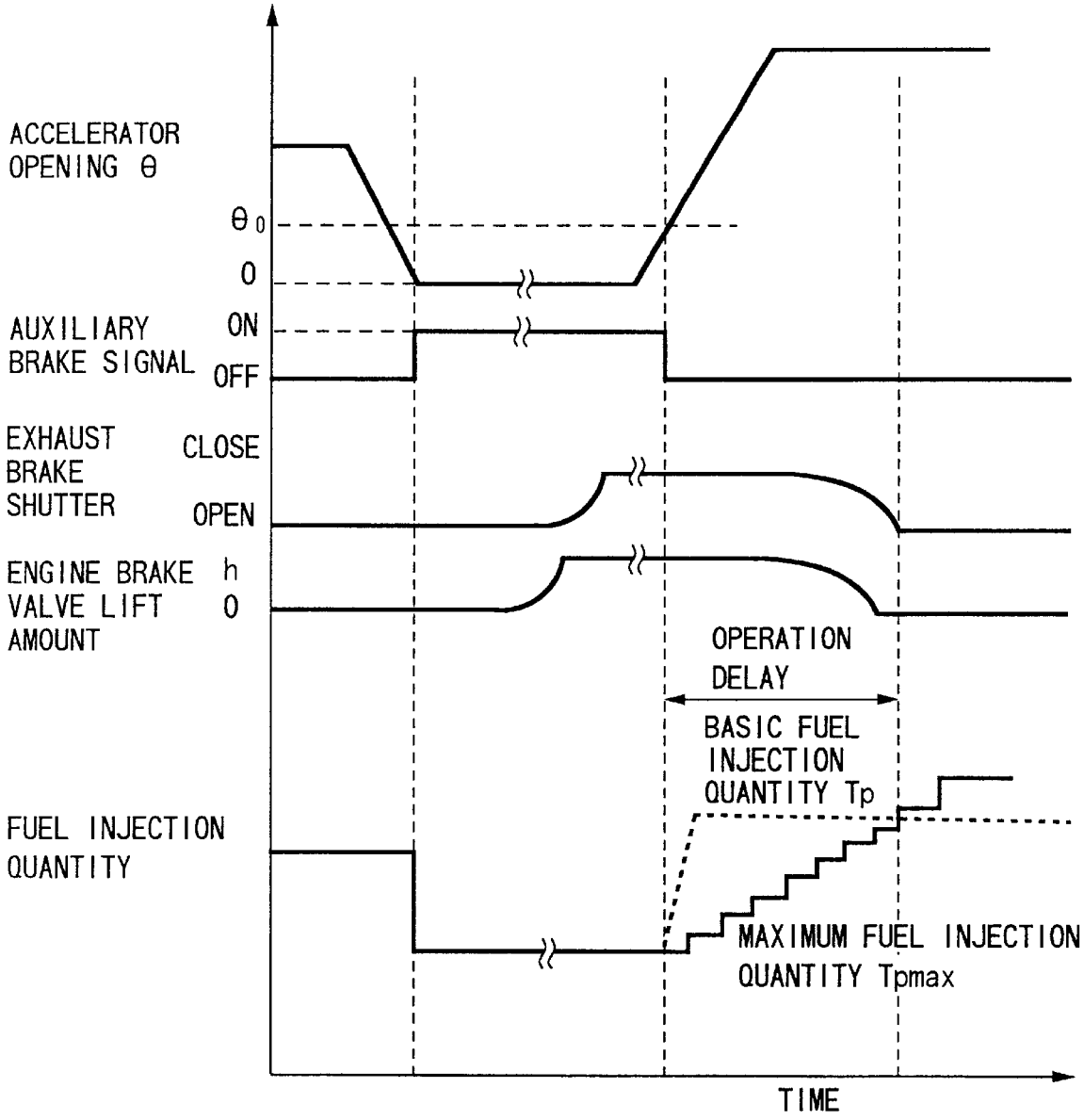
FIG. 6 is a time chart showing the various operations related to the fuel injection quantity control.

According to the fuel injection quantity control device explained above, the fuel injection quantity control as shown in FIG. 6 is performed. That is, when the accelerator opening θ becomes "0", the operating condition of the auxiliary brake is fulfilled, and the auxiliary brake signal turns from OFF to ON. Then, the exhaust brake and the engine brake start to operate, and the fuel injection quantity is switched to a value of during the operation of the auxiliary brake. At this time, since there exists a time delay in the operations of the exhaust brake and the engine brake, these brakes provide their maximum brake power with some time delay after the accelerator opening θ turns "0".

If the accelerator pedal is operated to accelerate the vehicle speed and the accelerator opening θ reaches a predetermined opening $\theta_0$ (for example, 5%) under such a state, since the operating condition of the auxiliary brake would no longer be fulfilled, the auxiliary brake signal is turned from ON to OFF. Then, the exhaust brake and the engine brake are released, but since there exists a time delay in the operations thereof, the auxiliary brake is released with some time delay. At this time, the basic fuel injection quantity Tp corresponding to the engine operating state is increased at once, but the maximum fuel injection quantity Tpmax is gradually increased stepwise corresponding to the elapsed time from when the auxiliary brake signal has been turned OFF. Then, the smaller value between the basic fuel injection quantity Tp and the maximum fuel injection quantity Tpmax is selected as the fuel injection quantity Te, to control the fuel injection device 8 based on the fuel injection quantity Te.

Figure 7:
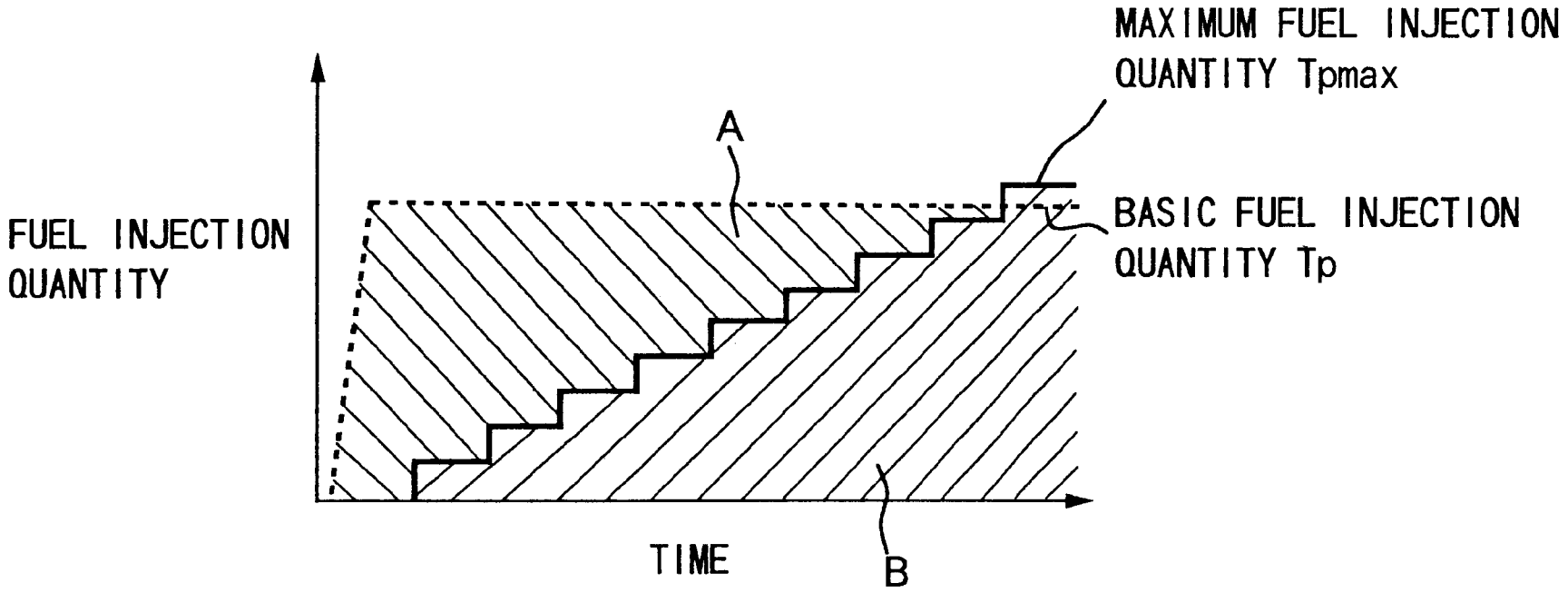
FIG. 7 is an explanatory view showing the effect of the fuel injection quantity control.

As shown in FIG. 7, since the upper value of the basic fuel injection quantity Tp is limited by the maximum fuel injection quantity Tpmax, excessive fuel supply can be prevented immediately after releasing the auxiliary brake, and the exhaust property is improved (refer to region A). Moreover, fuel can be injected immediately after releasing the auxiliary brake, enabling to secure good response after releasing the auxiliary brake (refer to region B).

The maximum fuel injection quantity Tpmax when releasing the auxiliary brake can also be computed using a map in which the fuel injection quantity is increases gradually and smoothly, instead of using the map shown in FIG. 5. Further, when using the map shown in FIG. 5, an interpolation operation is performed so that the fuel injection quantity can be increased gradually and smoothly. Moreover, the maximum fuel injection quantity Tpmax can be computed only for a predetermined time after the release of the auxiliary brake, and after that, can be fixed to a fixed value.

The above explained embodiment refers to the case where the present invention is applied to a diesel engine, but it is also possible to apply the present fuel injection quantity control device to a gasoline engine.

Industrial Applicability

As explained, the present invention can be applied to a diesel engine or a gasoline engine mounted on a vehicle, and contributes to improving the technology in the automobile industry.

What is claimed is:

1. a fuel injection quantity control device of an internal combustion engine comprising:

basic fuel injection quantity computing means for computing a basic fuel injection quantity based on the operating state of an engine;

maximum fuel injection quantity computing means for computing a maximum fuel injection quantity limiting the upper limit of said computed basic fuel injection quantity, as a first maximum fuel injection quantity which is the minimum value when an auxiliary brake is operating, and as a second maximum fuel injection quantity that is gradually increased corresponding to the elapsed time from when said auxiliary brake has been released, and exceeds said basic fuel injection quantity immediately after the release of said auxiliary brake has been completed when said auxiliary brake is not operating;

fuel injection quantity selecting means for selecting, as a fuel injection quantity, the smaller value between said computed basic fuel injection quantity and said maximum fuel injection quantity; and fuel injection control means for controlling a fuel injection device based on the selected fuel injection quantity.

2. The fuel injection quantity control device of an internal combustion engine according to claim 1, wherein said second fuel injection quantity is increased stepwise corresponding to the elapsed time from when said auxiliary brake has been released.

3. The fuel injection quantity control device of an internal combustion engine according to claim 1, wherein said maximum fuel injection quantity computing means computes said second fuel injection quantity by referring to a map in which a fuel injection quantity is set corresponding to the elapsed time from when said auxiliary brake has been released.

4. The fuel injection quantity control device of an internal combustion engine according to claim 2, wherein when a plurality of auxiliary brakes are equipped to said engine, said maximum fuel injection quantity computing means judges that the auxiliary brake is operating to compute the maximum fuel injection quantity when at least one of said auxiliary brakes is operating.

5. A method for controlling the fuel injection quantity of an internal combustion engine comprising the steps of:

computing a basic fuel injection quantity based on the operating state of said engine;

computing a maximum fuel injection quantity limiting the upper limit of said basic fuel injection quantity as a first maximum fuel injection quantity when an auxiliary brake is operating, and as a second maximum fuel injection quantity that is gradually increased corresponding to the elapsed time from when said auxiliary brake has been released, and exceeds said basic fuel injection quantity immediately after the release of said auxiliary brake has been completed when said auxiliary brake is not operating;

selecting, as a fuel injection quantity, the smaller value between said computed basic fuel injection quantity and said maximum fuel injection quantity; and controlling a fuel injection device based on the selected fuel injection quantity.

* * * * *